US006450817B1

(12) United States Patent
Deinlein

(10) Patent No.: US 6,450,817 B1
(45) Date of Patent: Sep. 17, 2002

(54) METHOD FOR SIMULATING THE DANGER POSED BY HAND GRENADES OR MINES TO PARTICIPANTS IN A MILITARY EXERCISE

(75) Inventor: Rudolf Deinlein, Immenstaad (DE)

(73) Assignee: Dornier GmbH, Friedrichshafen (DE)

( * ) Notice: Subject to any disclaimer, the term of this patent is extended or adjusted under 35 U.S.C. 154(b) by 0 days.

(21) Appl. No.: 09/601,175

(22) PCT Filed: Jan. 8, 1999

(86) PCT No.: PCT/DE99/00022

§ 371 (c)(1),
(2), (4) Date: Sep. 14, 2000

(87) PCT Pub. No.: WO99/39148

PCT Pub. Date: Aug. 5, 1999

(30) Foreign Application Priority Data

Jan. 29, 1998 (DE) ..... 198 03 337

(51) Int. Cl.[7] ..... F41A 33/00

(52) U.S. Cl. ..... 434/11; 434/12; 434/23; 102/427; 340/326; 703/6

(58) Field of Search ..... 434/11–27; 463/16, 463/22, 30, 47, 51; 273/148 B, 372; 102/293, 334, 335, 355, 401–407, 410, 411, 427, 498, 702; 455/39, 73, 500, 517; 324/258, 326, 327, 345; 89/1.11, 1.13, 41.01; 340/326, 568.1; 446/398, 401, 405, 473

(56) References Cited

U.S. PATENT DOCUMENTS

| | | | | | |
|---|---|---|---|---|---|
| 3,847,396 | A | * | 11/1974 | Ashford | 434/16 |
| 4,141,295 | A | * | 2/1979 | Campbell et al. | 102/407 |
| 5,027,709 | A | * | 7/1991 | Slagle | 102/427 |
| 5,074,793 | A | * | 12/1991 | Hambric et al. | 434/11 |
| 5,207,579 | A | * | 5/1993 | Campagnuolo | 434/11 |
| 5,246,372 | A | * | 9/1993 | Campagnuolo et al. | 434/11 |
| 5,292,254 | A | | 3/1994 | Miller et al. | |
| 5,474,452 | A | * | 12/1995 | Campagnuolo | 434/11 |
| 5,600,303 | A | * | 2/1997 | Husseiny et al. | 340/568.1 |
| 5,719,501 | A | * | 2/1998 | Spektor et al. | 324/345 |
| 5,788,500 | A | * | 8/1998 | Gerber | 434/22 |
| 5,801,322 | A | * | 9/1998 | Laine et al. | 102/401 |
| 6,004,209 | A | * | 12/1999 | Katsumoto et al. | 463/30 |
| 6,101,916 | A | * | 8/2000 | Panot et al. | 89/1.13 |
| 6,254,394 | B1 | * | 7/2001 | Draper et al. | 434/11 |
| 2001/0012784 | A1 | * | 8/2001 | Lazecki | 455/517 |

FOREIGN PATENT DOCUMENTS

| | | | |
|---|---|---|---|
| DE | 38 37 998 | 5/1990 | |
| DE | 196 17 060 | 11/1997 | |
| EP | 0 590 590 | 4/1994 | |
| EP | 0 668 481 | 8/1995 | |
| EP | 0 809 083 | 11/1997 | |
| GB | 2 176 271 | 12/1986 | |
| JP | 4-281200 | * 10/1992 | 102/427 |

* cited by examiner

*Primary Examiner*—Joe H. Cheng
(74) *Attorney, Agent, or Firm*—Crowell & Moring LLP

(57) ABSTRACT

The invention relates to a method for simulating the danger posed by mines or hand grenades to one or several participants in a military exercise. At least one weaponry simulator simulating a mine or a hand grenade and the sensor devices allocated to the individual participants are used and the effect of mines or hand grenades is simulated by transmitting data between the weaponry simulator and the sensor devices of the participants. According to the invention, data is transmitted through two-way radio communication between the weaponry simulator and the sensor devices of the individual participants. Radio transmission from the individual sensor devices of the participants to the weaponry simulator is carried out in the near field zone of the transmitting and receiving antennae involved. Such transmission serves to confine the effective area of the mines or hand grenades while the radio transmission from the weaponry simulator to the sensor devices of the individual participants serves to confirm or verify that the mines or hand grenades have hit a target.

9 Claims, 3 Drawing Sheets

METHOD FOR SIMULATING THE DANGER POSED BY HAND GRENADES OR MINES TO PARTICIPANTS IN A MILITARY EXERCISE

BACKGROUND AND SUMMARY OF THE INVENTION

This application claims the priority of PCT International Application No. PCT/DE99/00022, filed Jan. 8, 1999 (08.01.99) and German patent document 198 03 337.0, filed Jan. 29, 1998 (29.01.98), the disclosures of which is expressly incorporated by reference herein.

The invention relates to a method for realistic simulation of the danger posed by individual mines, mine blocks and hand grenades to participants in military exercises, particularly soldiers and vehicles.

As a result of the invention, the use of such explosive devices can be practiced during training with entirely harmless consequences, and the offensive effect of mines and hand grenades can be determined objectively in simulated combat. For this purpose, a mine or hand grenade is simulated by a weaponry simulator, and participants in the exercise (particularly personnel and vehicles) are equipped with a sensor system (herein called "participant sensor system"). The ranges of action of the mines and hand grenades are simulated by a data transmission between the weaponry simulators and the participant sensor systems.

An object of the invention is to provide a method for simulating precisely the range limitation of the mine or hand grenade, in order to achieve a reliable determination of the participants situated within the range of action of the triggered mine or hand grenade.

This and other objects and advantages are achieved by the method according to the invention, in which data are communicated from the weaponry simulator to the individual participant sensor systems via two-way radio transmission. The radio transmission from the individual participant sensor systems to the weaponry simulator is used to limit the range of action of the mines or hand grenades to be simulated. For this purpose, the field pattern in the near field of the transmitting and receiving antennas is utilized. A "hit" is possible only when the near field of the transmitting antenna at the participant sensor system overlaps with the near field of the receiving antenna on the weaponry simulator.

A transmission frequency is selected whose near field range is larger than the maximum required range of action of the mine or hand grenade to be simulated. For the relationship between the near field r and the frequency f, the following applies according to general physical principles:

$$r \leqq c/2nf \text{ (c: velocity of light).}$$

In order to simulate the ranges of action of typical mines and hand grenades (several m to several km), frequencies in the range of from several kHz to several tens of MHz can therefore be used for transmission. This frequency range includes particularly the MW and LW range (LW long wave, approximately 30–300 kHz; MW medium wave, approximately 300 kHz–3 MHz).

A mine or hand grenade hit is confirmed or verified by radio transmission from the weaponry simulator to the individual participant sensor systems. In principle, no limitation exists for this transmission with respect to the used frequencies. However, advantageously frequencies in the VHF or UHF range (VHF very high frequency, approximately 30 to 300 MHz; ultra high frequency, approximately 300 to 3,000 MHz) are used.

A participant's hit takes place when a confirmed communication is established between the participant sensor system and the weaponry simulator.

The range of action limitation according to the invention by a radio transmission in the near field range (for example, in the LW or MW range) from the participant sensor system to the weaponry simulator permits a precise and accurate simulation of the action of various mine types and hand grenades. In particular, a covered as well as an exposed condition is possible.

The use of radio transmission from the weaponry simulator to the individual participant sensor systems (for example, in the UHF or VHF range) to confirm a hit achieves a high reliability when detecting the weaponry simulator.

In order to achieve a precise range of action limitation with a level measurement, in the case of a high-frequency transmission the transmission medium (including antennas) must have correspondingly high damping. Therefore, magnetic antennas (such as a ferrite rod with an antenna coil) are preferably used for the transmission from the participant sensor system to the weaponry, and the range of action limitation of the mines or hand grenades is achieved by utilization of the field pattern in the near field of these antennas.

The high damping in the transmission path has the advantage that the damping influences occurring in nature and civilization as a result of different soil conditions (cultivation), the weather, or an exposed or covered conditions play only a minor role.

The method according to the invention can be used to simulate mines as well as for hand grenades (HGR). The different characteristics of these systems can therefore be simulated with the same technical preparations. The following mine types can, for example, be simulated:

Anti-tank laying mine (PzAbwVMi)

Anti-gunner mine (SchtzAbwMi)

Anti-gunner laying mine (SchtzAbwVMi).

The method according to the invention supports all mine laying principles, such as the mixed laying of mine blocks (PzAbwVMi) and individual mines (SchtzAbwVMi).

The method is designed for the mine combat simulation in combat exercise centers, for the combat of connected weapons, as well as a stand-alone solution for pure mine combat training.

In addition to the mine detection, the participant sensor systems mounted on vehicles or personnel also permit radio-technical linking of additional equipment.

Other objects, advantages and novel features of the present invention will become apparent from the following detailed description of the invention when considered in conjunction with the accompanying drawings.

DETAILED DESCRIPTION OF THE DRAWINGS

In all embodiments of the method according to the invention described herein, transmission from the participant sensor system to the weaponry simulator takes place, for example, in the MW range; and transmission from the weaponry simulator to the participant sensor system takes place, for example, in the UHF frequency range. As mentioned above, other frequency ranges are possible.

Figure 1:
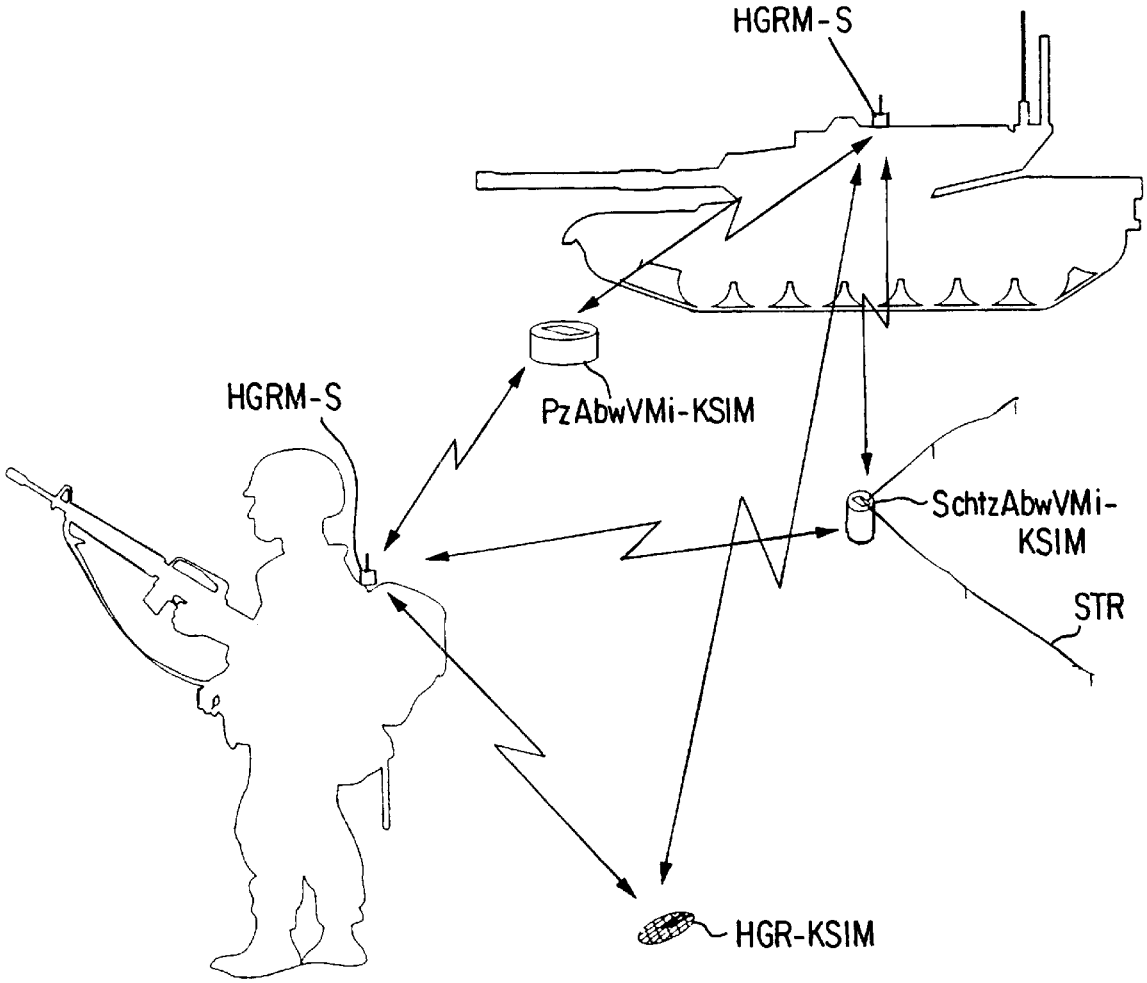
FIG. 1 is a view of the starting situation during implementation of the method according to the invention.

FIG. 1 illustrates the starting position for implementation of the method according to the invention. Two typical exercise participants are illustrated, specifically personnel and tanks, to each of which one participant sensor system HGRM-S is assigned. Furthermore, three types of possible weaponry simulators KSIM (HGR-KSIM, PzAbwVMi-KSIM, SchtzAbwVMI-KSIM), which simulate certain mine types or hand grenades, are illustrated. The SchtzAbwVMI-KSIM is triggered by the trip wire STR. The arrows between the individual weaponry simulators KSIM and participant sensor systems HGRM-S symbolize the possible transmission paths in the event of triggering a weaponry simulator.

Figure 2:
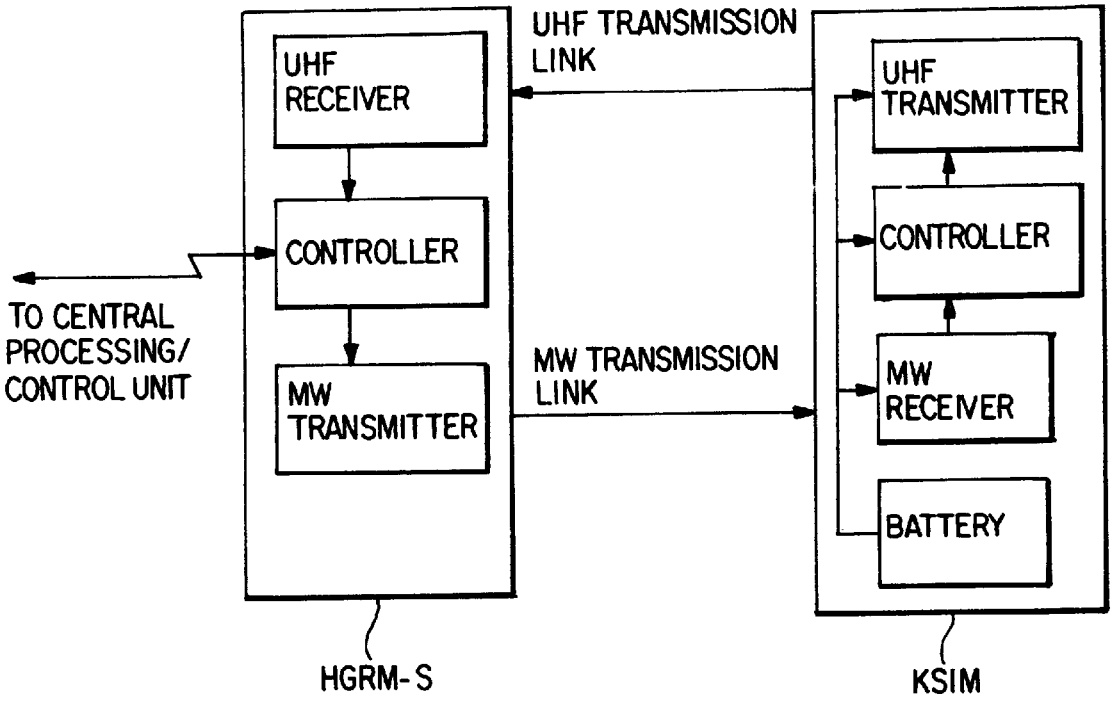
FIG. 2 is a block diagram of the overall system consisting of the weaponry simulator and the participant sensor system.

FIG. 2 is a block diagram of overall system consisting of the weaponry simulator KSIM and the participant sensor system HGRMS-S used to implement the method according to the invention, which is based on a combination of two radio transmission links between the weaponry simulator KSIM and the participant sensor system HGRM-S. The weaponry simulator KSIM illustrated in FIG. 2 comprises a UHF transmitter as well as an MW receiver, and correspondingly, the participant sensor system HGRM-S comprises a UHF receiver as well as an MW transmitter. The MW radio link from the participant sensor system to the weaponry simulator (transmission in the near field range) is used for the effect range limitation and for the information transmission. The UHF radio link from the weaponry simulator to the participant sensor system is used for the information transmission (confirmation of the MW reception).

A hit by a mine or a hand grenade has taken place when a confirmed communication between the participant sensor system and the weaponry simulator has been established. In this case, the communication takes place between the weaponry simulator and the participant sensor system, particularly according two similar methods which will be described in detail in the following.

The controller within the participant sensor system can transmit additional data transmission between the participant sensor system and a central processing and control unit (not shown). For example, the fact that the participant has been hit can be transmitted for further analysis.

The probability of radio collisions occurring outside the process is very low because of the limited local transmission ranges as well as the low event frequency (mine/HGR triggering, data transmission), the short transmission times (high bit rate, few data) and the asynchronism of mine/HGR triggerings.

The method according to the invention can be adapted to link additional equipment for the purpose of data transmission by radio. The coding of various weaponry simulators as well as other equipment is transparent to the outside; that is, additional equipment can utilize the data transmission link with an unchanged participant sensor system. The data at the interface of the participant sensor system HGRM-S to the central processing and control unit, on the one hand, and the data at the transfer interface (not shown in FIG. 2) of the weaponry simulator KSIM to the additional pieces of equipment, on the other hand, are the same.

The transmission power for data transmission to personnel and vehicles for mine simulation can be reduced, because the parameters of the transmission link are more constant and only small ranges (approximately 0.1 m to 3.0) need be bridged. In addition, in comparison to the mine simulation, data transmission has a low priority which is automatically taken into account in the participant sensor system.

The time-related utilization of the used frequency is directly related to the mine triggering and the data transmission. By means of the method according to the invention, such utilization is reduced to a minimum.

Figure 3A:
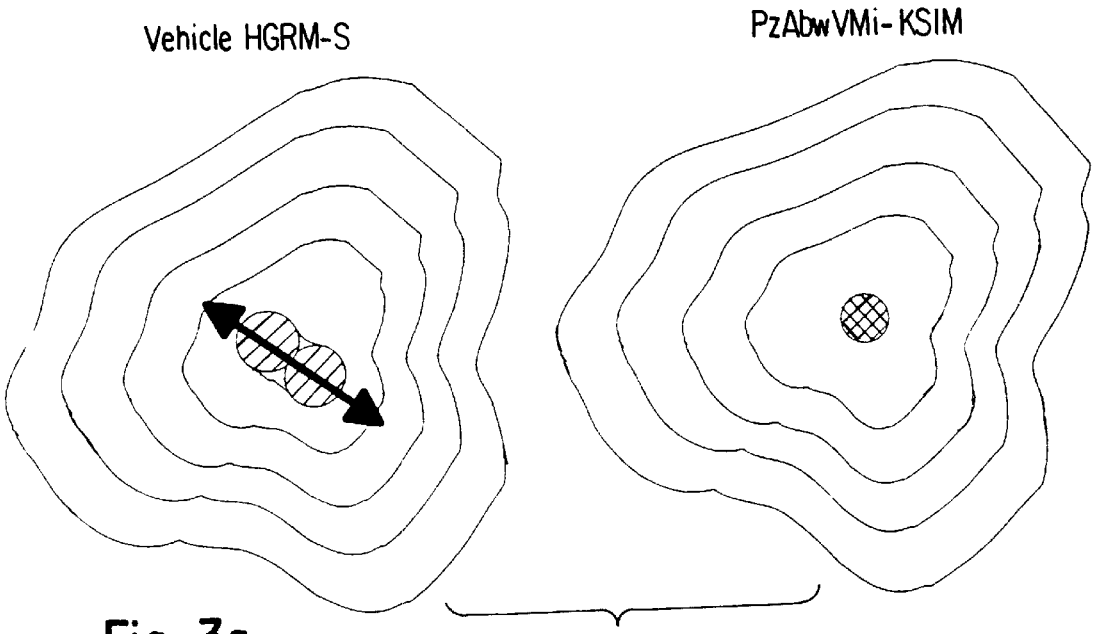
FIG. 3 is a view of the radio ranges of various weaponry simulators and participant sensor systems.
Figure 3B:
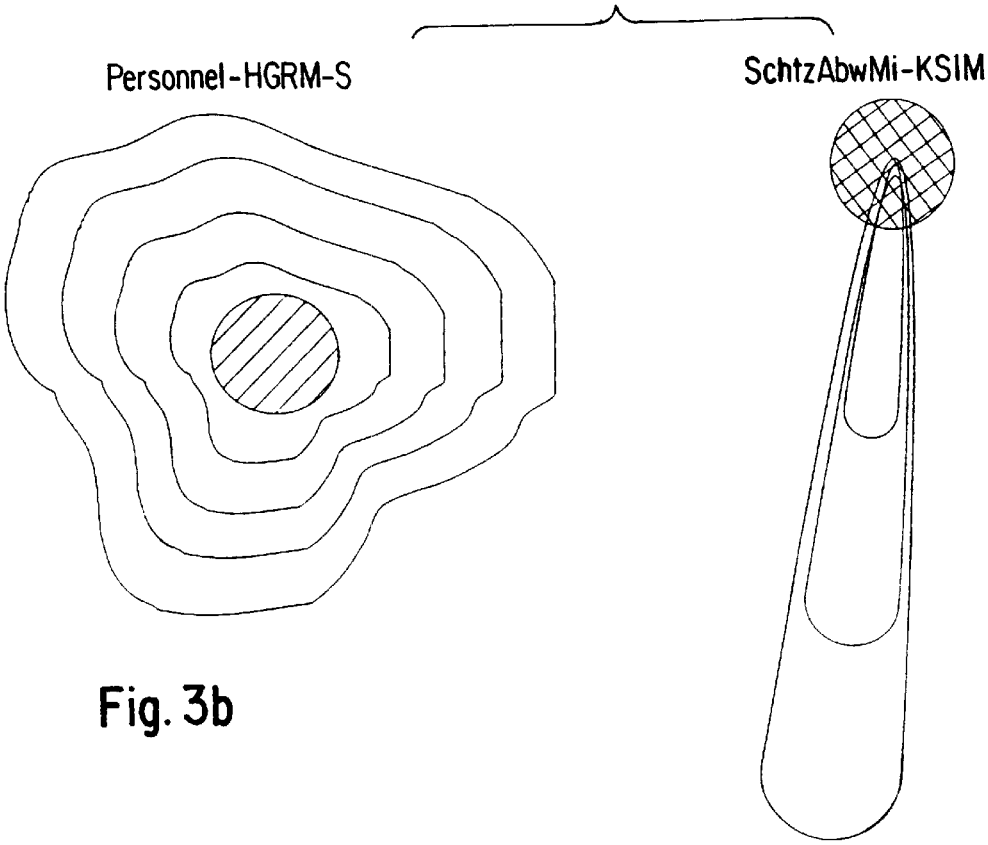

FIG. 3 shows examples of the radio transmission ranges of individual weaponry simulators and participant sensor systems, as used for the method according to the invention. FIG. 3*a*) illustrates the transmission range of a PzAbwVMI weaponry simulator and a vehicle participant sensor system. FIG. 3*b*) illustrates the transmission range of a SchtzAbwMi weaponry simulator and a personnel participant sensor system. The UHF transmission ranges are illustrated by concentric closed lines. The significantly smaller MW transmission ranges are hatched. They correspond to the near field of the used magnetic antennas.

The double arrow on the transmission range of the vehicle participant sensor system indicates the driving direction of the vehicle.

Since the MW transmission is used to limit the range of effect, the illustrated MW transmission ranges correspond exactly to the effect ranges of the PzAbwVMI or of the SchtzAbwMi. The simulation of the effect ranges is implemented by the directional character of the magnetic antenna (for example, ferrite antenna). Depending on the arrangement, for example, a 360° effect range or an effective range in the form of a figure eight or "hourglass" (vehicle participant sensor system) is generated. Furthermore, combinations of several magnetic antennas (for example, aligned in the direction of the x/y/z axis) are possible. The different ranges can be achieved by the different damping of the MW receiving antenna in the weaponry simulator or by the controlling of the MW transmission power in the participant sensor system. In the case of the SchtzAbwMi weaponry simulator, the directional effect in the UHF transmission range is achieved by a directed irradiation in the UHF range.

A complete two-way transmission in both illustrated situations in FIG. 3*a*), 3*b*) occurs only when there is an overlap of the single-line hatched MW transmitting range of the respective participant sensor system HGRM-S and of the cross-hatched MW reception range of the weaponry simulator KSIM. In the case of the SchtzAbwMi, the participant must also be in the illustrated UHF "lobe".

In the following, two particularly advantageous embodiments of the method according to the invention are illustrated in detail with reference to tables. Table 1 illustrates the implementation of a first embodiment of the method according to the invention; Table 2 illustrates the implementation of another embodiment of the method according to the invention; and Tables 3 to 7 are examples of the message construction during the radio transmission.

Method for Simulating the Offensive Effect of PzAbwVMi

The participant sensor system mounted on a vehicle continuously emits MW prompt signals according to Table 4. If a PzAbwVMi weaponry simulator receives a transmission on MW, it emits its weaponry simulator identification and the sender identification of the participant sensor system on its UHF transmitter (message construction according to Table 5). The participant sensor system at the triggering vehicle recognizes this and registers and reports the reception as a hit. If other participant sensor systems also receive the UHF emissions, they know that the emission does not originate from them because it occurs asynchronously to their prompting event and also contains an external participant identification. To save energy the participant sensor system with the personnel carries out no prompting emissions, and can therefore not be "hit" by PzAbwVMi, which complies with the reality of the application.

The described method replaces a high-expenditure original mine sensor system in the weaponry simulator and permits a high relative speed between the vehicles and the weaponry simulator.

As an alternative to the described MW transmission, an LW transmission can, for example, be used. Analogously, instead of the above-mentioned UHF transmission, for example, a VHF transmission can be used.

The constant MW prompt emissions of the participant sensor system in the case of vehicle are spatially limited to a surface of approximately 8 m×16 m, so that the vehicles do not hinder one another. This ensures the large-surface usability of the frequency.

The described embodiment of the method is again illustrated in detail in Table 1.

Method for Simulating the Offensive Effect of SchtzAbwVMi, SchtzAbwMi, HGR

In this embodiment of the method according to the invention, weaponry simulators are activated by certain effects, such as a trip wire triggering, an electric ignition, a projection, at the weaponry simulator itself. Until the time of the triggering, the electronic system as well as the receiver and transmitter of the weaponry simulator are in an inactive battery-saving condition ("sleep") . In the event of a triggering, the weaponry simulator emits a UHF transmission, identifying the Mine/HGR (message according to Table 3), and the participants in the UHF transmission range, which is significantly larger than the effective range of the mine/HGR, receive this message. Immediately upon reception, these participant sensor systems, controlled by the random sequence generator, attempt to establish a connection via the MW transmission link with the mine/HGR. The emissions of the participant sensor systems according to Table 4 are answered by the weaponry simulator directly in the UHF range (transponder method). Since each participant sensor system during the emission simultaneously listens at the UHF receiver, it can immediately determine whether its own emission or that of another participant is answered.

Participants which are outside the MW transmission range but within the UHF range will not be able to establish this connection (no hit). Each participant which has succeeded in establishing a connection has been hit by the mine/HGR. After the establishing of various connections has been concluded, the triggered mine/HGR becomes inactive again when the selectable maximum number of participants (for example, 31) has been reached or after a time criterion has expired. The maximum time duration of the process, (that is, in the case of 31 participants situated in the UHF transmission range of the triggering weaponry simulator) amounts to fractions of a second.

In an advantageous embodiment of the method according to the invention, the participant sensor system recognizes whether damage or injury to the participant by the triggered mine type is possible. (An example in which damage or injury is not possible is the combination of an armored vehicle and a hand grenade.) Only the damaged or injured participants will then carry out the described transponder method.

Table 2 again illustrates the described embodiment of the method in detail. In this embodiment, the MW transmission can be replaced, for example, by an LW transmission, and the UHF transmission can be replaced, for example, by a VHF transmission.

The time-related utilization of the frequencies in question is very low. Since the participant sensor systems with the personnel make no prompting emissions, they do not contribute to an additional radio load. When a mine is triggered, the UHF frequency is used in the framework of the transponder method several times for short periods (within a maximum time frame of 1 second/mine) and within a periphery of approximately 50 m to 200 m.

As mentioned above, after receiving the identification of the triggering weaponry simulator, the participant sensor systems situated in the UHF reception range of the triggering weaponry simulator attempt to establish a connection by way of the MW transmission link to the mine/HGR by means of the transponder method. The manner in which emissions of the individual participant sensor systems are coordinated and thus a collision resolution is reached, will is explained below.

After reception of a weaponry simulator identification, each participant sensor system generates a random number. After a certain time (defined by the random number) has expired, the individual participant sensor system checks whether another participant sensor system is already emitting. If no other participant sensor system is emitting, it starts with the described transponder method by the MW emission of the message according to Table 4 with the participant No. 1. The triggered weaponry simulator answers the emissions of the participant sensor system (message according to Table 4) such that each participant sensor system can determine in the UHF band whether there is a transmission in the MW band. If another participant sensor system is already emitting, the checking participant sensor system waits until the transponder process with the other participant sensor system is completed. In this case, all participant sensor systems receive the up-to-date identification of the participant sensor system which is just carrying out the transponder process. The next participant sensor system which starts with its transponder process emits with a participant number that is higher by one.

As a result of the described control of the sequence in which the individual participant sensor systems carry out the transponder process with the triggered weaponry simulator, by the generating and assignment of random numbers, a large address space (the number of all participants which participate in the exercise may be large, for example, in the range of 1,000 participants) is achieved into a significantly smaller address space (the number of participants which, when the weaponry simulator is triggered, are situated in its UHF reception range, will normally be lower than 10). This significantly speeds the process, which is important particularly in the case of fast moving participants (such as vehicles).

If two participant sensor systems have accidentally calculated the same random number and emit together, the closer transmitter will succeed or an undefined UHF emission will occur. After a reception error in the transponder process, a new random number is determined in each participant sensor system and the process is repeated with the last valid participant number. Each participant sensor system which was able to establish a connection to the triggered weaponry simulator separately terminates the transponder process. If, because of a large distance or a radio interference, a participant sensor system receives no answer from the weaponry simulator, it will twice more attempt to establish this connection. If unsuccessful, it terminates the process. If, after the first-time emission of its identification, the weaponry simulator receives no reaction in the form of the transponder process, it will twice more repeat its identification at time intervals of approximately one second. If an SchtzAbwVMi, SchtzAbwMi or HGR weaponry simulator recognizes that, when emitting the mine identification for the first time, another SchtzAbwVMi, SchtzAbwMi or HGR weaponry simulator is already carrying out the transponder process, the recognizing weaponry simulator will wait until the transponder process has been completed and will only then emit its mine identification for the first time.

The described approach reliably selects participants which are situated in the range of effect of a triggered mine/HGR.

Finding/Locating of the Mines/HGR

For finding/locating the mines/HGR (for example, after a concluded exercise), a direction finding system can advantageously be used.

A prompting transmitter (identical to the participant sensor system) can search a circular area of a diameter of approximately 80 m. For this purpose, all brought-out mines (HGR only after "detonation") recognize via their MW receiver a special identification of the prompting transmitter for the direction finding operation. As long as the prompting transmitter is active, a special UHF signal for the direction finding operation is generated in the mine/HGR. Commercially available radio direction finders are suitable for use as the direction finding system.

In the described method for simulating the danger posed by SchtzAbwVMi, SchtzAbwMi, HGR, the MW receiver is pulsed only after conclusion of the process, and is therefore operated in a current-saving manner in order to be able to receive the prompting transmitter of the direction finding system for the locating. In the case of the SchtzAbwVMi and the SchtzAbwMi, the MW receiver is already operated in a pulsed manner after arming, in order to be able to also search for mines which were not triggered.

Data Transmission

An important advantage of the method according to the invention is that the participant sensor systems mounted on vehicles or personnel, in addition to the mine detection, also permit the radio-technical linking of additional pieces of equipment. In this respect Table 6 shows a message as an example of the data transmission. Table 7 shows an example of a message for a confirmation.

TABLE 1

| Step | Effect HGRM-S | Effect KSIM | Remarks |
|---|---|---|---|
| 1. | Prompting (emitting the participant identification MW according to Table 4) | sleep mode (MW reception) | outside effect range |
| 2. | Prompting (emitting the participant identification MW according to Table 4) | MW reception, work mode | triggering of KSIM |
| 3. | Receive participant identification + mine identification by way of UHF | emit participant identification + mine identification by way of UHF according to Table 5 | |
| 4. | Report/register mine hits | | |
| 5. | Sleep mode (UHF reception) | Sleep Mode (MW reception) | |

TABLE 2

| Step | Effect HGRM-S | Effect KSIM | Remarks |
|---|---|---|---|
| 1. | Sleep mode (UHF reception) | sleep mode | |
| 2. | Sleep mode (UHF reception) | triggering of KSIM | in the case HGR time delay |
| 3. | Receive mine identification | emit mine identification according to Table 3 | |
| 4. | Participant 1 emits on MW according to Table 4 and simultaneously receives its emission on UHF | MW reception and UHF emission according to Table 4 | |
| 5. | Participant 1 reports/registers mine hits | | then sleep mode for HGRM-S on participant 1 |
| 6. | Participant 2 emits on MW according to Table 4 and receives its emission simultaneously on UHF | MW reception and UHF emission according to Table 4 | |
| 7. | Participant 2 reports/registers mine hits | | subsequently sleep mode for HGRM-S on participant 2 |
| 8. | . . . | . . . | . . . |
| 9. | Participant n emits on MW according to Table 4 and simultaneously receives its emission on UHF | MW reception and UHF emission according to Table 4 | max. 31 participants can be differentiated |
| 10. | Participant n reports/registers mine hits | | subsequently sleep mode for HGRM-S on participant n |
| 11. | Sleep mode (UHF Reception) | time delay | |
| 12. | Sleep mode (UHF Reception) | sleep mode (MW reception) | |

TABLE 3

| Bit No. | Meaning | Remarks |
|---|---|---|
| 1 | Identification bit | always "0" |
| 2 | bit mine type.15 | max. 65535 different mines displayable |
| 3 | bit mine type.14 | |
| 4 | bit mine type.13 | |
| 5 | bit mine type.12 | |
| 6 | bit mine type.11 | |
| 7 | bit mine type.10 | |
| 8 | bit mine type.9 | |
| 9 | bit mine type.8 | |
| 10 | bit mine type.7 | |
| 11 | bit mine type.6 | |
| 12 | bit mine type.5 | |
| 13 | bit mine type.4 | |
| 14 | bit mine type.3 | |
| 15 | bit mine type.2 | |

TABLE 3-continued

| Bit No. | Meaning | Remarks |
|---|---|---|
| 16 | bit mine type.1 | |
| 17 | bit mine type.0 | |
| 18 | Parity | "1" bits of No. 1–17 = odd, then "1" |

TABLE 4

| Bit No. | Meaning | Remarks |
|---|---|---|
| 1 | Identification bit | always "0" |
| 2 | HGRM sensor system on participant | "0" = soldier, "1" = vehicle |
| 3 | bit participant.4 | max. 31 different "hit" |
| 4 | bit participant.3 | particip.can be displayed |
| 5 | bit participant.2 | |
| 6 | bit participant.1 | |
| 7 | bit participant.0 | |
| 8 | parity | "1" bit number of No. 1–7 = even, then "1" |

If a message according to Table 3 was not received correctly (for ample, parity error, transmission interference), by means of the participant No. "0", the mine identification can be requested again.

TABLE 5

| Bit No. | Meaning | Remarks |
|---|---|---|
| 1 | Identification bit | always "0" |
| 2 | HGRM sensor system on participant | "1" = vehicle |
| 3 | bit participant.4 | max. 31 different "hit" |
| 4 | bit participant.3 | particip.can be displayed |
| 5 | bit participant.2 | |
| 6 | bit participant.1 | |
| 7 | bit participant.0 | |
| 8 | bit mine type.15 | max. 65535 different mines |
| 9 | bit mine type.14 | displayable |
| 10 | bit mine type.13 | |
| 11 | bit mine type.12 | |
| 12 | bit mine type.11 | |
| 13 | bit mine type.10 | |
| 14 | bit mine type.9 | |
| 15 | bit mine type.8 | |
| 16 | bit mine type.7 | |
| 17 | bit mine type.6 | |
| 18 | bit mine type.5 | |
| 19 | bit mine type.4 | |
| 20 | bit mine type.3 | |
| 21 | bit mine type.2 | |
| 22 | bit mine type.1 | |
| 23 | bit mine type.0 | |
| 24 | Parity | "1" bit no. of No. 1–21 = even, then "1" |

TABLE 6

| Bit No. | Meaning | Remarks |
|---|---|---|
| 1 | 1st identification bit | condition always "1" |
| 2–16 | target address 15 bits | highest-order bit first |
| 17 | confirmation | always "0" |
| 18–32 | sender address 15 bits | highest-order bit first |
| 33–56 | data 24 bits | 3 bytes |
| 57–64 | check sum | bytes 1–7 added |

TABLE 7

| Bit No. | Meaning | Remarks |
|---|---|---|
| 1 | 1st identification bit | condition always "1" |
| 2-16 | target address 15 bits | highest-order bit first |
| 17 | confirmation | "1" correct, "0" incorrect |
| 18 | parity | "1" bit number of No. 1–17 = even, then "1" |

If a message according to Table 6 was not received correctly (for example, parity error, transmission interference), by means target address "0" (negative confirmation) the message can be requested again.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for simulating an offensive effect of mines or hand grenades to at least one participant in a military exercise, using at least one weaponry simulator for simulating mines or hand grenades, and participant sensor systems which are assigned to individual participants, said method comprising:

simulating effects of the mines or hand grenades by two-way radio transmission of data between the at least one weaponry simulator and participant sensor systems, including communicating an effective range limitation of the mines or hand grenades by radio transmission to the at least one weaponry simulator from the participant sensor systems, in a near field range of transmitting and receiving antennas of the at lest one weaponry insulator and the participant sensor systems; and confirming a hit by the mines or hand grenades by radio transmission from the weaponry simulator to participant sensor systems;

wherein radio transmission from the at lest one weaponry simulator to participant sensor systems is performed in a very high frequency or ultra high frequency range.

2. The method according to claim 1, wherein:

radio transmission from participant sensor systems to the at least one weaponry simulator is performed in a medium wave or long wave frequency range.

3. The method according to claim 1, wherein radio transmission from the at least one weaponry simulator to individual participant sensor systems is performed in a VHF or UHF frequency range.

4. The method according to claim 1, wherein magnetic antennas are used for transmitting and receiving in the near field range.

5. The method according to claim 1 wherein two-way transmission between the at least one weaponry simulator and participant sensor systems is performed by:

repeatedly transmitting the participant identification by participant sensor systems;

the at least one weaponry simulator receiving the participant identification, with establishment of transmission between a particular participant sensor system and the at least one weaponry simulator being considered as triggering the at least one weaponry simulator and as a hit of the particular participant sensor system;

the at least one weaponry simulator transmitting the weaponry simulator identification as well as the participant identification of the particular participant sensor system to the particular participant sensor system;

the particular participant sensor system receiving the weaponry simulator identification as well as of the participant identification of the particular participant sensor system; and registering such receipt as a hit.

6. The method according to claim 1, wherein two-way transmission between the at least one weaponry simulator and a participant sensor system is performed by:

the at least one weaponry simulator transmitting the weaponry simulator identification;

a participant sensor system receiving the weaponry simulator identification;

the participant sensor system transmitting the participant identification;

the at least one weaponry simulator receiving the participant identification, establishment of transmission being treated as a hit of the transmitting participant sensor system by the receiving weaponry simulator;

the weaponry simulator transmitting the participant identification to the participant sensor system; and a participant sensor system receiving the participant identification and registering such receipt as a hit.

7. The method according to claim 6, wherein transmission of the participant identification by the participant sensor system and the receipt of the participant identification by the participant sensor system take place substantially simultaneously.

8. The method according to claim 6, wherein when multiple participant sensor systems receive a weaponry simulator identification from a triggering weaponry simulator, a sequence in which the multiple participant sensor systems transmit their participant identification to the weaponry simulator is determined randomly.

9. The method according to claim 6, wherein after receiving a weaponry simulator identification, the particular participant sensor system carries out a check to determine whether a hit of an assigned participant is permitted because of the type of the triggering weaponry simulator, and if the result is negative, does not carry out further process steps.

* * * * *